United States Patent [19]

Rivas et al.

[11] Patent Number: 4,750,865

[45] Date of Patent: Jun. 14, 1988

[54] SUBSURFACE STUFFING BOX ASSEMBLY

[75] Inventors: Olegario Rivas, San Antonio; Alejandro Newski, Miranda, both of Venezuela

[73] Assignee: Intevep, S.A., Caracas, Venezuela

[21] Appl. No.: 910,066

[22] Filed: Sep. 22, 1986

[51] Int. Cl.[4] ..... F04B 47/00

[52] U.S. Cl. ..... 417/53; 417/448; 417/554

[58] Field of Search ..... 417/554, 553, 552, 545, 417/448, 450, 313, 53, 358

[56] References Cited

U.S. PATENT DOCUMENTS

| | | | |
|---|---|---|---|
| 138,477 | 5/1873 | Carll | 417/448 |
| 2,522,825 | 9/1950 | Hoffer | 417/553 X |
| 3,040,673 | 6/1962 | Dunbar | 417/448 X |
| 3,045,606 | 7/1962 | Schmidt | 417/448 |
| 3,102,495 | 9/1963 | Page | 417/450 X |
| 4,102,608 | 7/1978 | Balkau et al. | 417/242 |
| 4,440,231 | 4/1984 | Martin | 417/448 X |

FOREIGN PATENT DOCUMENTS

| | | | |
|---|---|---|---|
| 0630238 | 10/1961 | Canada | 417/552 |
| 0778489 | 7/1957 | United Kingdom | 417/448 |

*Primary Examiner*—Leonard E. Smith
*Assistant Examiner*—Eugene L. Szczecina, Jr.
*Attorney, Agent, or Firm*—Bachman & LaPointe

[57] ABSTRACT

A method and apparatus for pumping high viscosity fluids such as viscous crude oils using a reciprocating pump powered by a reciprocating rod string where friction between the viscous fluid and the rod string and the resulting floatation effect are reduced greatly or substantially eliminated.

13 Claims, 3 Drawing Sheets

SUBSURFACE STUFFING BOX ASSEMBLY

BACKGROUND OF THE INVENTION

The present invention relates to fluid pumping from subsurface wells and relates, in particular, to pumping high viscosity fluids such as viscous crude oils using a reciprocating rod string.

In prior art systems, pumping viscous fluids through a production tube string by means of a reciprocating rod string driving a recriprocating pump, friction between the rod string and the viscous-fluid has created serious problems.

For example, extra power is required to drive the reciprocating rod through the viscous fluid.

This difficulty leads frequently to buckled or bent rods, tube damage and in severe cases parting of the rod string.

The highly viscous fluids also create a flotation effect tending to buoy the rod resulting in uneven cyclic power requirements putting an undesirable strain of the gear box of the rod driving mechanism. This occurrence frequently leads to premature failure of a very expensive gear train.

This excessive friction and flotation effect operates to slow the pumping speed reducing the flow of product.

SUMMARY OF THE INVENTION

Consequently it is a prime feature of the present invention to provide a pumping system for viscous fluids which reduces substantially or reduces to a minimum undesirable friction and the resulting flotation effect between a reciprocating rod string and the viscous fluid.

A further feature of the invention is the provision of a novel pumping method for viscous fluids.

A still further feature of the invention is the provision of a novel assembly for insertion into the production tube of a fluid well operative to provide a reservoir for low viscosity fluids surrounding the reciprocating rod string.

A still further feature of the invention is the provision of a flow path for viscous fluids that by-passes the main body of the production tube.

A further feature of the invention involves the use of the annular space that normally exists between a well casing and a product tube to advance viscous fluid product while reserving a substantial portion of the product tube as a low viscosity fluid reservoir for lubricating a reciprocating rod string within the product tube string.

A still further feature of the invention is the provision of an assembly of elements within a tubular housing for insertion into a production tube where the assembly and the production tube provide a conduit leading from a pump, to the annular space between the production tube and the casing while maintaining a fluid seal above and below said conduit.

An assembly embracing certain principles of the present invention useful to facilitate pumping high viscosity fluids from fluid wells having a well casing, a production tube within the casing and an annular space between the tube and the casing may comprise an elongated tubular housing, a first segment of said housing enclosing a stuffing box including compressible packing material, a second contiguous segment of said housing having a fluid outlet, a third contiguous segment of said housing defining a pump casing, and a plurality of friction rings encircling said assembly for seating said assembly within said production tube and for creating a fluid tight seal between the tubular housing and the production tube.

A method embracing certain other principles of the present invention may include the steps of providing a production tube spaced from a well casing to create an annular space between the well casing and the tube, extending a reciprocating pump rod into said production tube, providing an opening in the production tube leading from the interior of the production tube to the annular space, creating a fluid tight seal in said production tube above said opening and around said pump rod, introducing and containing low viscosity fluid in said production tube above said opening and around said pump rod, and pumping viscous fluid through said annular space via said opening.

Other features and advantages of the present invention will become more apparent from an examination of the succeeding specification when read in conjunction with the appended drawings in which:

DETAILED DESCRIPION OF THE PREFERRED EMBODIMENTS

Figure 1:
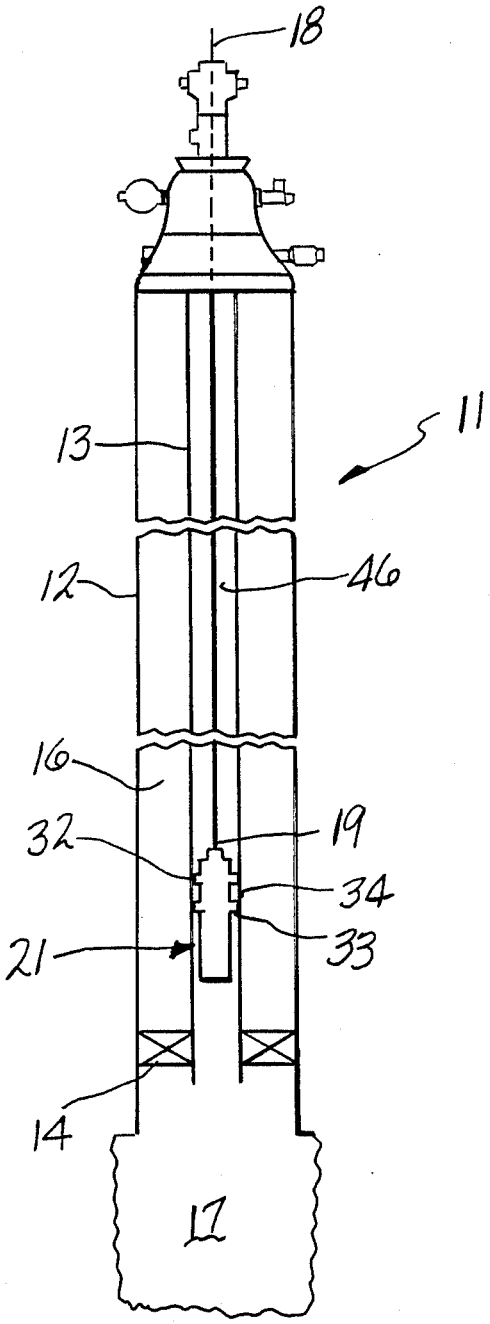
FIG. 1 is a schematic illustration of a production well configuration utilizing the principles of the present invention.

Referring now in detail to the drawings the reference numeral 11 designates a completed well including a casing 12, a production tube 13 with the usual and customary packing 14 isolating an annular space 16 from the well formation 17.

A reciprocating rod string 18 terminates at a reciprocating pump rod 19 projecting from a tubular housing indicated generally at 21.

Figure 2:
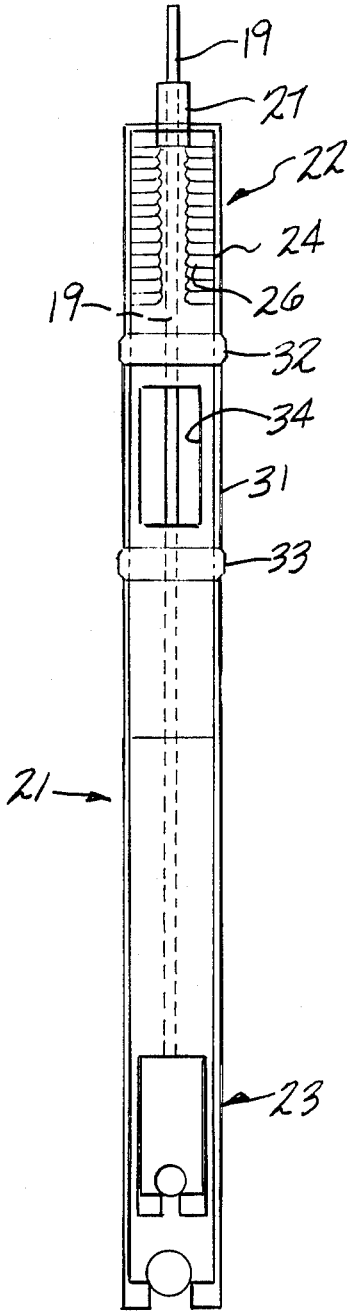
FIG. 2 is a further schematic view showing the tubular housing which is inserted into the production tube, and FIGS. *3a* & *3b* are sectional views, enlarged, showing in greater detail the elements within the tubular housing and the relationship between the housing and the production tube.

The housing 21, lowered by the rod string 18 and supported by the production tube 13, encloses a stuffing box 22, and a reciprocating pump 23 and is insertable as an assembly into the production tube. The housing cooperates with the production tube in a manner which will be described in greater detail as the details of FIGS. 2 and 3 are stated.

The tubular housing 21 enclosing an assembly of elements is an elongated member composed of a first tubular segment 24 housing the stuffing box 22 including a mass of compressible packing material 26 surrounding the reciprocating pump rod 19.

Figure 3A:
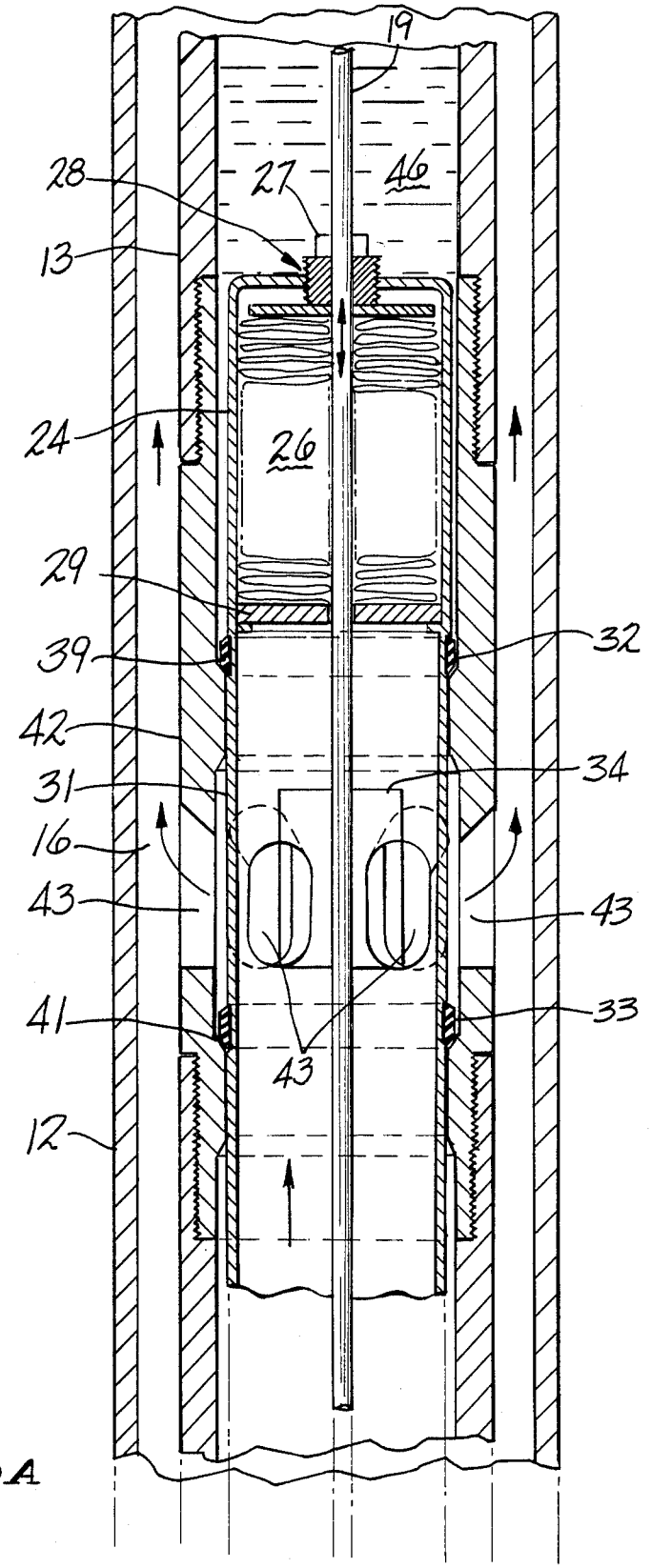
Figure 3B:
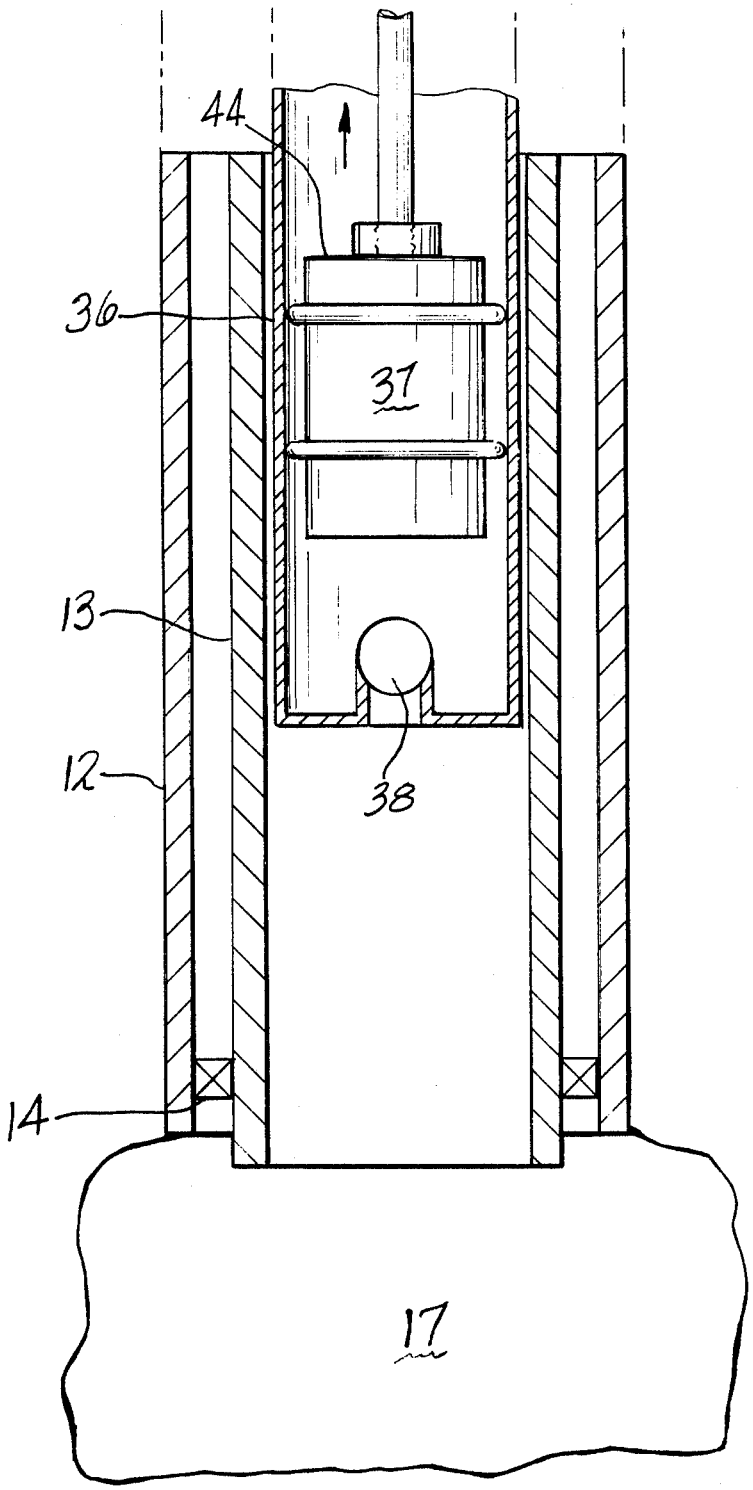

The packing is compressed by the nut means 27 in threaded engagement with the segment 24 as indicated at 28 in FIG. 3.

The packing is compressed against a suitable base plate 29 to create a snug, fluid tight sliding fit about the reciprocating pump rod 19.

The next contiguous tubular segment 31, defined as the second segment in the succeeding claims, is formed with spaced peripheral undercuts to receive and position friction rings 32 and 33.

The rings 32–33, which may take the form of thermosetting or vulcanized elastomeric O-rings are spaced above and below a fluid outlet 34.

The third tubular segment 36 forms the cylinder or housing for the piston 37 which operates to draw viscous fluids through ball check valve 38 in well known fashion.

The friction rings 32 and 33 are located on the tubular housing 21 to correspond to and mate with seat means 39 and 41 formed in a section 42 of the production tube 13.

The seat means 39 and 41, spaced above and below openings 43 in the production tube, cooperate with the friction rings to create a fluid tight seal between the exterior of the tubular housing and the internal surface of the production tube above and below the openings 43.

The cooperation of the friction rings and the seat means serve to register the fluid outlet 34 with the openings 43 to create a conduit leading from the discharge side 44 of the pump 37 to the annular space 16.

Thus the combination of the stuffing box 22 and the upper seat means 39 (first seat means) and the upper friction ring 32 (first friction ring) create a sealed reservoir 46 for receiving and containing low viscosity fluid thereby providing substantially reduced friction and reduced flotation effect upon the reciprocating rod string.

Obviously the combination of the lower seat means 41 (second seat means) and the mating friction ring 33 (second friction means) cooperate to insure that the viscous fluid pumped flows up the interior of the tubular housing 21 and discharges into the annular space 16 via the conduit defined by housing outlet 34 and production tube openings 43–43.

In general, the language high viscosity or viscous fluids is intended to denote those fluids whose viscosity is in excess of 1500 centistokes while the range low viscosity represents those fluids having a viscosity range up to 1500 centistokes.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An assembly for insertion as a compact unit into a fluid well to facilitate pumping high viscosity fluids, said well including a well casing, a production tube within the casing and an annular space between the tube and the casing, comprising:

an elongated tubular housing within said production tube, a first segment of said housing enclosing a stuffing box and having an opening for receiving a reciprocating pump rod, said stuffing box including a compressible packing material, a base plate within said housing, and means for selectively compressing said packing material against said base plate to effect a fluid type seal about said rod, a second contiguous segment of said housing having a fluid outlet communicating with said annular space, a third contiguous segment of said housing defining a pump casing enclosing a reciprocating pump having a piston, and a plurality of friction rings encircling said tubular housing and a plurality of tubular seat means provided on the internal surface of the production tube for seating said tubular housing within said production tube wherein said friction rings seat on said tubular seat means for creating a fluid tight seal between the tubular housing and the production tube while allowing said tubular housing to be easily and readily removed from said production tube.

2. The assembly of claim 1 in which the friction rings are disposed on opposite sides of said fluid outlet.

3. The assembly of claim 2 in which the friction rings encircle said second segment of said tubular housing.

4. The assembly of claim 3 in which the friction rings are received in and supported by peripheral undercuts formed on the exterior surface of said second segment.

5. The assembly of claim 4 in which the friction rings define O-rings fabricated from a thermosetting elastomer compound.

6. The assembly of claim 1 in which the compressing means comprises a member having a clearance opening for said pump rod, and said member being in threaded engagement with a portion of said first housing segment.

7. The assembly of claim 1 in which a first friction ring creates a fluid tight seal above said fluid outlet and a second friction ring creates a fluid tight seal below said fluid outlet.

8. The assembly of claim 1 in which the reciprocating pump is operated by said pump rod which is received within and is coextensive with said tubular housing.

9. The assembly of claim 8 in which said third segment terminates in a normally closed check valve.

10. In combination, the assembly of claim 1 in which the production tube includes a section having an opening communicating with said annular space and said section includes seat means mating with at least one of said friction rings for supporting and positioning said assembly relative to the production tube.

11. The combination of claim 10 in which the seat means and said at least one friction ring are disposed relative to the product tube and the tubular housing, respectively, so that the fluid outlet of said tubular housing communicates directly with the opening in said production tube.

12. The combination of claim 11 in which a first seat means is disposed above said opening and a second seat means is disposed below said opening and a first friction ring mates with said first seat means and a second friction ring mates with said second seat means effective to create fluid seals above and below said opening.

13. A method for reducing friction and flotation effect on a reciprocating pump rod extending within a production tube for pumping high viscosity fluids such as viscous crude oils comprising the steps of: providing a well casing; spacing said production tube from said well casing to create an annular space therebetween; providing an opening in said production tube leading from the interior of the tube to the annular space; providing an elongating tubular housing within said tube having a first segment enclosing a stuffing box which includes a compressible packing material and a plate within said housing, a second segment having an opening which communicates with said tube opening and a third segment enclosing a pump; extending said reciprocating pump rod into said production tube and into said housing through an opening to operate said pump; introducing and containing a low viscosity fluid in said tube above said housing and around said pump rod; and creating a fluid tight seal in said production tube to separate said high viscosity and low viscosity fluids, said fluid tight seal creating step comprising sealing the exterior of the housing on a plurality of tubular seat means provided on the external surface of the production tube above and below said openings so as to allow said tubular housing to be easily and readily removed from said production tube and compressing said packing material against said plate within said housing to create a fluid seal about said pump rod.

* * * * *